US005310066A

United States Patent [19]

Konstant

[11] Patent Number: 5,310,066

[45] Date of Patent: May 10, 1994

[54] CANTILEVER RACK STORAGE SYSTEM

[75] Inventor: Anthony N. Konstant, Winnetka, Ill.

[73] Assignee: Konstant Products, Inc., Skokie, Ill.

[21] Appl. No.: 967,809

[22] Filed: Oct. 28, 1992

[51] Int. Cl.[5] ..... A47F 5/00

[52] U.S. Cl. ..... 211/193; 211/187; 108/109

[58] Field of Search ..... 211/187, 193, 186, 182; 108/108, 109

[56] References Cited

U.S. PATENT DOCUMENTS

| | | | |
|---|---|---|---|
| 3,556,306 | 1/1971 | Shell | 108/108 X |
| 3,827,377 | 8/1974 | Aughtry | 211/193 X |
| 3,938,668 | 2/1976 | Konstant | 211/182 X |
| 4,078,664 | 3/1978 | McConnell | 211/187 X |
| 4,101,233 | 7/1978 | McConnell | 211/187 X |
| 4,344,367 | 8/1982 | Merl | 211/187 X |
| 4,919,282 | 4/1990 | Duff et al. | 211/187 X |
| 5,074,422 | 12/1991 | Holtz | 211/187 |

*Primary Examiner*—Robert W. Gibson, Jr.
*Attorney, Agent, or Firm*—Niro, Scavone, Haller & Niro

[57] ABSTRACT

An improved cantilever rack storage system having a number of vertically spaced, horizontal load supporting surfaces wherein the front and rear beams are releasably secured to the cantilever arms without the use of bolts or similar fasteners and where each load supporting surface is further stabilized by the use of cross arms which also do not require bolts and fasteners.

8 Claims, 2 Drawing Sheets 20
14
21
18
16
20
22
22
21
20
11
12
18
50
22
14
20
10
21
50
21
12

CANTILEVER RACK STORAGE SYSTEM

BACKGROUND OF THE INVENTION

The present invention relates generally to cantilever rack storage systems. More particularly, the present invention relates to cantilever rack storage systems that do not require labor intensive hardware such as bolts to attach the front and rear beams to the cantilever arms, the cross arms to the front and rear beams or to attach the decking to the cross beams, front and rear beams and the cantilever arms.

As the cost of materials, construction, labor and freight continue to rise, warehouse owners and operators put increasing emphasis on storage systems that provide maximum storage capability and flexibility at the lowest possible cost. As a result, rack structures that are capable of easy assembly and adjustment are in high demand. The rack structures, however, must be stable and sturdy to provide for safe and effective storage. The rack systems must also be capable of providing the maximum amount of storage area for a given operation and set-up.

In the past, warehouse operators have used cantilever rack storage structures for a wide variety of storage applications, particularly where storage of objects of varying sizes are desired. Through the use of such cantilever systems (see e.g., U.S. Pat. No. 3,028,976), floor space is saved, material costs reduced and storage flexibility increased because the structures are self-supporting and do not require overhead or aisle support members. Known cantilever storage systems typically include a horizontal base which supports a vertical column or standard. One or more cantilever arms are then secured to the vertical columns. Front (aisle) and rear beams are typically used to interconnect the front and rear ends of the cantilever arms as well as intermediate cross arms between the front and rear beams for additional support. Decking for supporting the products to be stored is placed over the cantilever, cross arm and beam structure to provide a flat, generally horizontal storage area. Most, if not all, of the members in such systems are typically welded to one another or connected by a large number of bolts and similar hardware. Systems of this type are costly and labor intensive in assembling and provide for little storage flexibility.

Another cantilever rack storage system that minimizes the complexity of assembly is disclosed in U.S. Pat. No. 3,854,686. Cantilever rack systems of this type employ a bracket which is welded to an inner end of a cantilever arm comprised of two partially welded elongated tubes. The bracket of this system is forcibly wrapped around a vertical standard and thus does not require bolts or fasteners to secure the cantilever arm to the vertical standard.

An additional known cantilever rack storage system that also minimizes the difficulty of assembly is disclosed in U.S. Pat. No. 3,679,067. This storage rack structure has the ability to connect generally tubular cantilever arms to generally tubular front support beams through the use of integral brackets which are secured to the cantilever arms and are then inserted into the hollow ends of the tubular front support beams. In this manner, a secure connection is provided between the front support beam and the cantilever arms without the need for additional fasteners or welding. Systems of this type, however, still require the use of fasteners to attach the integral brackets to the cantilever arms, and can only be used with systems employing tubular shaped support beams. Like other known systems, this type of system provides little storage flexibility.

Accordingly, a need exists for a cantilever type storage system which maximizes space efficiency and maintains safe storage, while minimizing the need for complex assembly and the need for bolts, similar fasteners or welds.

SUMMARY OF THE INVENTION

The present invention preserves the advantages of known cantilever rack storage systems. In addition, it provides new advantages not found in current systems and overcomes many of the disadvantages of known systems.

Therefore, an object of the present invention is to provide a storage system that is easier and less costly to assemble.

Another object of the present invention is to provide a cantilever rack system that enables the attachment of the front beam and the rear beam to the cantilever arms without the use of bolts or welds.

An additional object of the present invention is to provide a cantilever rack storage system where the front and rear beams are securely and releasably attached to the cantilever arms by mounting members that do not require bolts or other hardware.

A further object of the present invention is to provide a cantilever rack storage system with cross arms for extra support and stability when necessary or desired and without the need for bolts or a weld to attach the cross arms between the front and rear beams.

Yet another object of the present invention is to provide for the installation of cross arms without the necessity for bolts or welds and which also prevent the front and rear beams from disengaging from their releasable mounting means.

Yet an additional object of the present invention is to enable the cross arms to be mounted to the front beams through brackets affixed to or made integrally from the front beams.

Yet a further object of the present invention is to provide a generally even, unobstructed deck surface.

Still another object of the present invention is to provide front and rear deck stops to secure the decking to the horizontal support plane without the use of fasteners.

Still an additional object of the present invention is to permit the construction of a cantilever rack storage system from a wide variety of readily available structural components.

And yet a further object of the present invention is to provide a means for securing the front and rear beams to the front and rear end portions of the cantilever arms without the necessity of bolts, similar hardware or welds.

And still a further object of the present invention is to provide an improved cantilever rack type storage structure that is easy to assemble, inexpensive to manufacture and that safely and efficiently stores a wide variety of loads.

In accordance with the objects, features and advantages of the present invention, a cantilever rack type storage system is provided having horizontal base members that support vertical columns or standards. Secured to and extending from the vertical columns are horizontally projecting cantilever arms that are adjacent another on opposing columns on generally the same horizontal plane. A front beam is provided which is attached to the front or distal end of each opposing cantilever arm by means for securably and releasably mounting the front beams to each of the cantilever arms. A rear beam is provided which is attached to the proximal or rear end of each opposing cantilever arm by means for securably and releasably mounting the rear beams to each opposing cantilever arm. A plurality of cross arms may also be provided between the front and rear beams for additional support and to help secure the front and rear beams in proper position. The cross arms are attached to the front beam through a front bracket member which engages an end of the cross arm. The cross arm is attached to the rear beam by hooking itself over the top of the rear beam. Decking is then placed over the horizontal support structure created by the front and rear beams, the cross arm and the cantilever arms to create a generally horizontal support surface. The decking is recessed below the top of the front beam and is secured by stops on the rear beam which prevent the forward or backward movement of the decking. The front and rear beams, the cross arms, and the decking are all secured and assembled without resort to bolts or welds.

BRIEF DESCRIPTION OF THE DRAWINGS

These and other objects, features, advantages and embodiments of the present invention, together with its organization and manner of operation, will become apparent with reference to the following description and accompanying drawings, wherein like reference numerals represent like elements throughout the several views and in which.

DETAILED DESCRIPTION OF THE PREFERRED EMBODIMENTS

Figure 1:
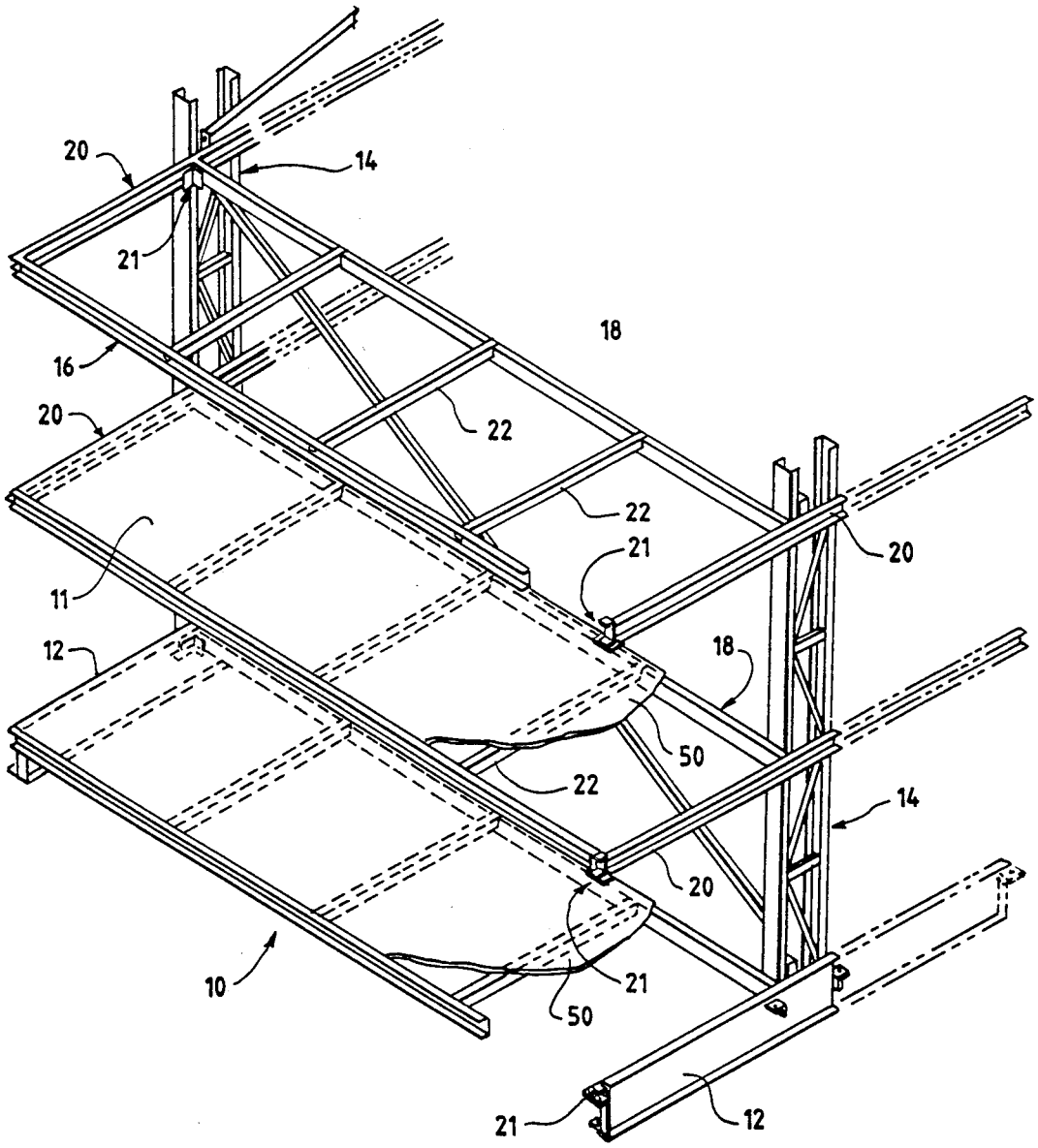
FIG. 1 is a perspective view of an embodiment of the present invention with portions removed to reveal aspects of the invention.

A preferred embodiment of the improved cantilever rack storage system of the present invention is show generally as 10 in FIG. 1. The cantilever rack system 10 includes a horizontal base 12, a plurality of vertical support columns or standards 14 and at least one pair of opposed cantilever arms 20 extending generally horizontally from each standard 14. It will be understood by those of ordinary skill in the art that any desired number of opposed cantilever arms may be welded, bolted or otherwise secured to the columns at vertical spacing consistent with the loads to be stored. At least one front beam 16 and at least one rear beam 18 are provided and which are designed to extend between adjacent and opposing cantilever arms 20, thus providing the support frame for an elevated horizontal support plane 11. In a preferred embodiment, the front and rear beams 16 and 18 are members having a substantially C-shaped cross section. However, it will be understood by those of ordinary skill in the art and consistent with the present invention that front beam 16 and rear beam 18 may have alternative cross section configurations, such as tubular or I-shaped cross sections.

Figure 2:
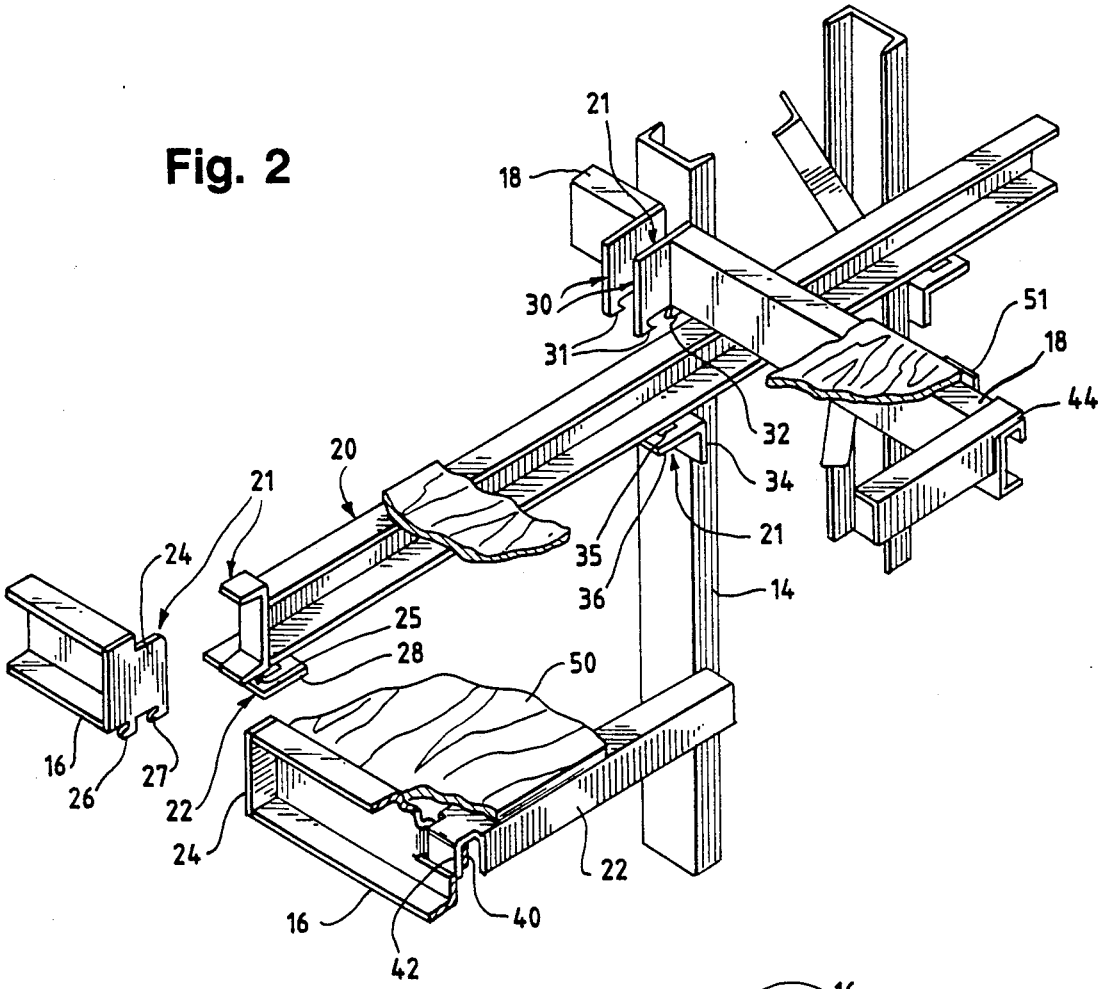
FIG. 2 is an exploded perspective view of an embodiment of the front and rear beam mounting means, the cross arm support brackets and other features of the present invention.

A preferred form of front and rear beams 16 and 18 mounting means shown generally as 21 may best be seen by reference to FIG. 2. A front beam receiving mount 22 is welded or otherwise secured to an outer end of cantilever arm 20. A front beam mounting plate 24 is secured to each longitudinal end of front beam 16. Front beam receiving mount 22 also defines an aperture 25 which receives a rear tab portion 26 of the front beam mounting plate 22. Front beam mounting plate 24 also has a rear tab 27. Both front tab 26 and rear tab 27 extend downward from the end of the front beam 16 and form a generally L-shape. The front tab 26 engages the aperture 25 defined by the front beam receiving mount 25, while the rear tab 27 engages a rear edge 28 of front beam receiving mount 25. As shown in FIG. 2, a series of front beams 16 and mount means 21 may be provided depending upon the amount of storage required.

Similarly, rear beam 18 includes a rear beam mounting plate 30 attached to each end, each longitudinal end of rear beam 18. Each rear mounting plate 30 includes a downwardly extending front tab 31 and a downwardly extending rear tab 32, each of which form a general L-shape. A rear beam receiving mount 34 is also provided which may be welded or secured to the rear or proximal end of cantilever arm 20 and/or to vertical column 14. The rear beam receiving mount 34 also defines an aperture 35 which is designed to accommodate the rear tab 32 of the rear beam mounting plate 30. Front tab 31 of rear mounting plate 30 is designed to accommodate and engage a forward edge 36 of the rear beam receiving plate 30. Like the front beams 16, mounting means 21 and cantilever arm 22, any desired number of rear beams IS and mounting means 21 may be connected depending upon the amount of storage desired.

Once the front and rear tabs 26 and 27 of front mounting plate 24 are appropriately engaged with the front beam receiving mount 22 and front and rear tabs 31 and 32 of rear beam mounting plate 30 are appropriately engaged with the rear beam receiving mount 30, the front and rear beams 16 and 18 are spread apart locking them into place. That is, front beam 16 is urged toward the front and rear beam 16 is urged toward the rear. The front and rear beams 16 and 18 are further prevented from disengagement with the front and rear beam mounting means 22, 24, 30 and 34, through the use of one or more cross arms 22 as best shown in FIGS. 1 and 2.

In addition to aiding in the unwanted displacement of the front and rear beams 16 and 18 from the mounting means shown generally as 21, the cross arms 22 also prevent twisting or shogging movement of the ends of the cantilever arms 20 when under load. Undesired twisting of the cross arms 20 could endanger the stability and safety of the storage rack system. The presence of one or more cross arms 22 also provides additional support for the storage of loads.

Figure 3:
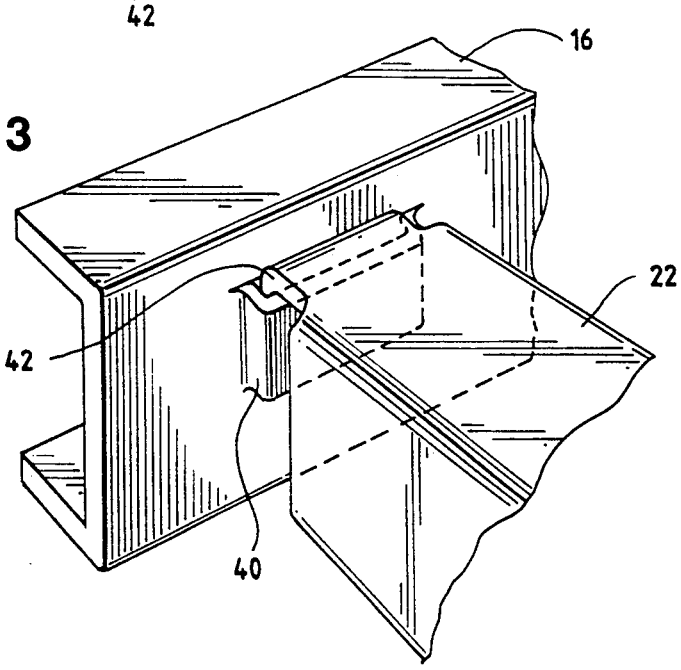
FIG. 3 is a perspective view of an embodiment of a front cross arm support bracket.

Like the mounting and assembly of front arms 16 and rear arms 18 that do not require the use of on-site hardware, cross arms 22 are also designed for assembly without the use of on-site, labor intensive hardware. As shown in FIGS. 2 and 3, a front end of cross beam 22 is cut and bent or otherwise manipulated to form an integral hanger 42. The rear end of cross arm 22 is cut and bent or otherwise provided with an integral hanger member 44 (FIG. 2). It will be understood by those of ordinary skill in the art that front and rear hangers 42 and 44 can be a variety of configurations depending upon the type of structural components used, or may consist of separate pieces welded or otherwise secured to each of the ends of cross arm 22.

Also as shown in FIGS. 2 and 3, front beam 16 is provided with a bracket 40. Bracket 40 may be formed out of or integral with a web portion of front beam 16. For example, parallel spaced slices may be cut along the length of front beam 16 and the portion between the slices pushed toward the rear to form bracket 40. Alternatively, bracket 40 may be welded or otherwise secured to the web of front beam 16. It will be further understood by those of ordinary skill in the art that bracket 40 may be formed or attached at regular, predetermined intervals along the length of front beam 16 to accommodate the placement of additional cross arms 22 where necessary or desired to support given loads.

The installation of cross arm 22 is best shown in FIGS. 2 and 3. Front hanger 42 of cross arm 22 is inserted into front beam bracket 40. The rear hanger 44 of cross arm 22 is placed over rear beam 18. In this manner, cross arm 22 may be installed without the need for hardware or welding. In addition, because rear hanger assembly 44 may be slightly oversized, exact measuring or positioning of components is not necessary.

Alternatively, rear hanger member 44 of cross arm 22 may be secured to rear beam 18 in a manner similar to front hanger 42 to front beam 16. This embodiment, however, may require more exact correspondence between the sizing and function of rear hanger 44 and rear beam 18.

Once the front and rear beams 16 and 18 and the cross arms 22 are installed, a decking material 50 may be placed over the support structure assembly which provides the shelving used to store the desired loads (not shown). Decking 50 may consist of plywood, particle board or any other suitable material. As shown in FIGS. 2 and 3, because of the design and assembly of the front and rear beams 16 and 18 and the cross arms 22 in accordance with the present invention, a lip or recess is provided on front beam 16 where the cross arms 22 are secured as well as with the connection of the front beam 16 to the cantilever arms 20. The lip is designed to correspond with the thickness of decking material 50 and results in a smooth surface throughout the support shelf 11. In addition, a rear deck top 51 may be provided to prevent decking 50 from sliding rearward during loading and/or unloading.

It will further be understood by those of ordinary skill in the art that the cantilever arms 22 may extend on two sides of the vertical columns 14 and thereby provide multi-sided storage capability (see FIG. 1) in the same manner as that described above.

While preferred embodiments of the present invention have been illustrated and described, it will be understood that changes and modifications can be made without departing from the invention in its broader aspects. Various features of the present invention which are believed to be new are set forth in the accompanying claims.

What is claimed is:

1. An improved cantilever rack storage system comprising:

at least one pair of horizontally spaced cantilever arms projecting from at least one pair of vertical columns, said cantilever arms having a front end and a rear end;

at least one front beam extending transversely between said front end of said cantilever arms;

at least one rear beam extending transversely between said rear end of said cantilever arms;

mounting means to releasably secure said front beam to the front end of said cantilever arms;

mounting means to releasably secure said rear beam to the rear end of said cantilever arms; and at least one cross arm extending between and releasably secured at one end to said front beam and at the other end to said rear beam.

2. The invention of claim 1 including a decking material affixed to a support structure of said cantilever arms, said cross arms and said front and rear beams.

3. The invention of claim 2 wherein said rear beam includes a deck stop to prevent the displacement of said decking from said support structure.

4. The invention of claim 3 wherein the mounting means for said front beam includes a lip to accommodate said decking material and form a stop to prevent the displacement of said decking material.

5. In a cantilever rack storage system having a plurality of vertical support columns, a plurality of horizontal base members to support the columns and at least one pair of opposed horizontally extending cantilever arms having a rear end extending to a front end and secured to said columns at a rear end, the invention comprising:

at least one front beam extending transversely between the front end of said cantilever arms having mounting means at each end of said front beam;

at least one rear beam extending transversely between the rear end of said cantilever arms and having mounting means at each end of said rear beam;

a front receiving means for securely and releasably cooperating with said mounting means of said front end to releasably secure said front beam to said cantilever arm;

a rear receiving means for securely and releasably cooperating with said rear mounting means of said rear end to releasably secure said rear beam to said cantilever arms; and at least one cross arm releasably secured at one end to said front beam and at another end to said rear beam.

6. The invention of claim 5 further comprising a stop means on said front and rear beams for preventing the unwanted displacement of a decking material.

7. An improved cantilever rack storage system including at least one elevated horizontal support plane, each plane comprising:

two horizontally spaced cantilever arms each projecting from a vertical column, each such arm having a front end and a rear end, each end of each such cantilever arm including a mount which defines an aperture;

a front beam, said front beam having substantially a c-shaped cross section, the edges of said c-shape cross-section facing forward, said front beam extending transversely between the front ends of said cantilever arm, each end of said front beam having a bracket with at least one tab to slidingly engage an aperture defined by the receiving mount on the front ends of each adjacent cantilever arm;

a rear beam, said rear beam having a substantially c-shaped cross section, the edges of said c-shape facing rearward, said rear beam extending transversely between the rear ends of said cantilever arms, each end of said front beam having a mounting plate with at least one tab to slidingly engage an aperture defined by the receiving mount on the inner ends of each adjacent cantilever arm;

at least one cross arm having a front end and a rear end;

a bracket which is integrally formed out of the surface of said front beam;

a front hanger formed integrally out of the front end of said cross arm, said integral hanger slidably engagable with said bracket; and a rear hanger formed integrally out of the rear end of said cross arm, said rear hanger overlapping said rear beam.

8. An improved cantilever storage system comprising:

at least one pair of horizontally spaced cantilever arms projecting from at least one pair of vertical columns, said cantilever arms having a front end and a rear end;

at least one front beam extending transversely between said front end of said cantilever arms;

at least one rear beam extending transversely between said rear end of said cantilever arms;

front mounting members releasably securing said front beam to the front end of said cantilever arms, said front beam engaged by said front mounting members when said front beam is urged toward the front end of said cantilever arms;

rear mounting members releasably securing said rear beam to the rear end of said cantilever arms, said rear beam engaged by said mounting members when said rear beam is urged toward the rear end of said cantilever arms;

decking material affixed to a support structure formed of said cantilever arms, and said front and rear beams;

a deck stop on said rear beam to prevent the displacement of said decking from said support structure; and a lip on said front mounting members to accommodate said decking material and form a stop to prevent the displacement of said decking material.

* * * * *